US005850648A

United States Patent [19]

Morson

[11] Patent Number: 5,850,648

[45] Date of Patent: Dec. 22, 1998

[54] VENTILLATED MATTRESS WITH SEMI-SPHERICAL PROJECTIONS

[76] Inventor: Luciana Morson, Via Divisione Julia 8, 33078 S. Vito Al Tagliamento (PN), Italy

[21] Appl. No.: 951,941

[22] Filed: Oct. 17, 1997

[30] Foreign Application Priority Data

Jun. 5, 1997 [IT] Italy ..... UD97A0103

[51] Int. Cl.[6] ..... A47C 27/15

[52] U.S. Cl. ..... 5/724; 5/727; 5/944

[58] Field of Search ..... 5/724, 727, 728, 5/730, 944

[56] References Cited

U.S. PATENT DOCUMENTS

| | | | |
|---|---|---|---|
| 3,974,532 | 8/1976 | Ecchuya | 5/724 |
| 4,161,045 | 7/1979 | Regan | 5/727 |
| 4,335,476 | 6/1982 | Watkin | 5/730 |
| 4,524,473 | 6/1985 | Fanti | 5/724 |
| 4,580,301 | 4/1986 | Ludman et al. | 5/727 |
| 4,980,940 | 1/1991 | Isshiki | 5/724 |
| 5,430,901 | 7/1995 | Farley | 5/728 |

FOREIGN PATENT DOCUMENTS

| | | | |
|---|---|---|---|
| 2473291 | 7/1981 | France | 5/730 |
| 2025234 | 1/1980 | United Kingdom | 5/944 |

*Primary Examiner*—Alex Grosz
*Attorney, Agent, or Firm*—Adams & Wilks

[57] ABSTRACT

An anatomical mattress comprises at least two layers of elastic material each having a main surface. The elastic layers are joined along the main surfaces thereof to define a generally parallelepiped-shaped body. The body has a peripheral frame and two opposite surfaces. At least a portion of one of the opposite surfaces of the body has semispherical-shaped elements extending outwardly therefrom and defining a lying plane of the mattress. At least two transverse reinforcing and stiffening bands are disposed in the body at positions corresponding generally with the shoulders and feet, respectively, of a user.

36 Claims, 2 Drawing Sheets fig. 3a (-C-)

VENTILLATED MATTRESS WITH SEMI-SPHERICAL PROJECTIONS

BACKGROUND OF THE INVENTION

1. Field of the Invention

The present invention relates to mattresses and, more particularly, to an anatomical mattress made of elastic material. The anatomical mattress according to the present invention is specifically designed to ensure maximum comfort for the user due to its anatomical characteristics and to achieve an optimum compromise between adapting to the physical characteristics of the user and not losing its own shape. A further characteristic of the present invention is that it ensures that the skin can "breathe", which is particularly appreciated when the mattress is used in the summer months.

2. Background of the Invention

There are a wide range of mattresses on the market which are of the elastic type and/or which are at least partly anatomical, or which at least claim such characteristics. Materials traditionally used to make at least partly elastic mattresses are for the most part foamed materials. There are also single-block mattresses, made of latex or similar materials, wherein the lower face, unlike the upper face which is substantially flat and continuous, includes cavities distributed in a substantially uniform manner. Single-block latex mattresses of this type are made in a mold by foam polymerization of a rubber substance.

However, mattresses known to the state of the art are not able to guarantee the user a comfortable lying position which will avoid problems to the backbone resulting from an incorrect support of the various parts of the body. This is principally due to the fact that these mattresses are not able to achieve an efficacious compromise between elasticity and rigidity. Thus, on the one hand, the elastic characteristics make them apparently comfortable and, on the other hand, the limited rigidity causes them to deform under the weight of the body, which makes the user's backbone bend.

Even in those cases where the mattresses consist of several layers of different densities joined together, the above-mentioned problems are not resolved. On the contrary, these problems are often increased by further problems relating to the skin's inability to "breathe".

The present applicant has therefore studied and investigated the foregoing problem in all its aspects and has searched for a solution suitable to guarantee maximum comfort, irrespective of the physical and anatomical characteristics of the user and the season when or environment where the mattress is used. The present invention is the result of these studies and investigations intended to overcome the shortcomings of the conventional art and to achieve further advantages as set forth hereinafter.

SUMMARY OF THE INVENTION

The mattress according to the present invention is of the anatomical type and is made of elastic material. "Anatomical" here means that it is ergonomically shaped and adaptable, and thus able to support the user according to his/her physical characteristics, where it is most needed, ensuring a comfortable lying position and support, without the presence of any areas of deformation or bending. The elastic material used, according to a preferential but non-restrictive embodiment, is a type of rubber known as latex.

The mattress according to the present invention comprises at least two layers of elastic material joined along main surfaces thereof to define a body inside of which are inserted a plurality of reinforcing and stiffening bands in a direction substantially at a right angle to the length of the mattress.

According to the present invention, there are preferably two or more reinforcing and stiffening bands. When there are two reinforcing and stiffening bands, one of them is located in correspondence with the shoulders of the user and at least one reinforcing and stiffening band is located in correspondence with the user's feet.

According to a further variant, there are three reinforcing and stiffening bands which are positioned respectively in correspondence with the user's shoulders, buttocks and feet.

According to a further variant, each reinforcing and stiffening band has its own defined density which is different from that of another reinforcing and stiffening band.

According to the present invention, the mattress has a lying plane defined and shaped with elements which have at least a semi-spherical head (hereinafter referred to as "semispherical-shaped elements"). The semi-spherical-shaped elements, which are in contact with the parts of the user's body, exert a massaging action when the user, during sleep or before or after sleep, moves in the bed. This massaging action has a beneficial effect on the circulation of the blood and gives the user a pleasant feeling of well-being.

According to the present invention, each of the semispherical-shaped elements has a top portion having a hole extending along at least part of its height. Preferably, the holes are through holes extending along the entire thickness of the layer of elastic material on which the semi-spherical-shaped element is disposed.

According to a further variant, the holes, either dead holes or through holes are disposed between adjacent semispherical-shaped elements.

The holes in the foregoing embodiments have a ventilating function, that is, to allow air to pass and, therefore, assist the intake and outlet of the air, thereby allowing the user's skin to breathe. This is particularly appreciated when the mattress is used in the summer months or in particularly hot and humid environments.

According to another variant, the mattress has a peripheral frame which is substantially flat and without any semi-spherical-shaped elements.

According to another variant, the semi-spherical-shaped elements have a variable size and/or arrangement so that they define areas with a differentiated density according to their lengthwise position on the mattress.

According to a further variant, the mattress has semispherical-shaped elements on both faces, so as to define a summer side and a winter side, according to the type of covering.

BRIEF DESCRIPTION OF THE DRAWINGS

The attached figures are given as non-restrictive examples and show some preferred embodiments of the present invention as follows:

FIG. 3*a* shows the detail C of FIG. 2 on an enlarged scale;

FIG. 3*b* is a cross-section taken substantially on the line A—A of FIG. 3*a;*

FIG. 4*a* shows the detail D of FIG. 2 on an enlarged scale; and

FIG. 4*b* is a cross-section taken substantially on the line B—B of FIG. 4*a*.

DETAILED DESCRIPTION OF THE PREFERRED EMBODIMENTS

Figure 1:
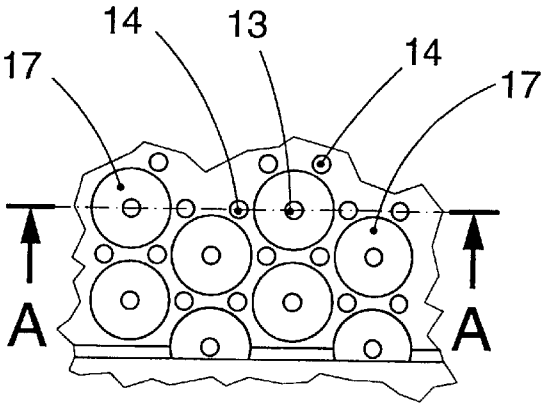
FIG. 1 shows a three dimensional view, in part section, of a mattress according to the present invention.
Figure 1:
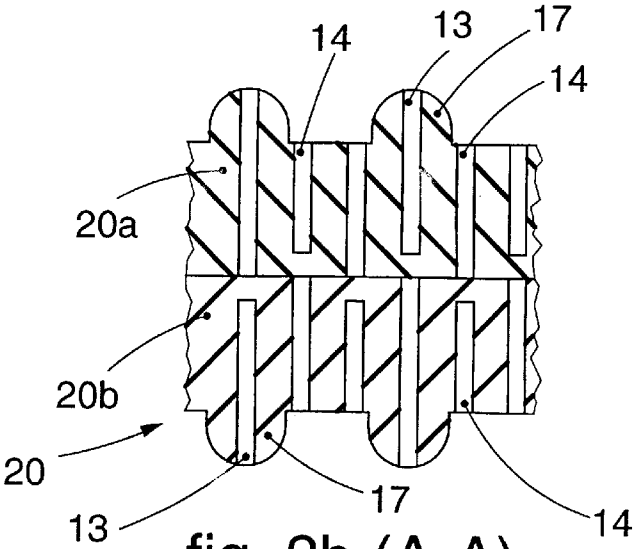
Figure 1:
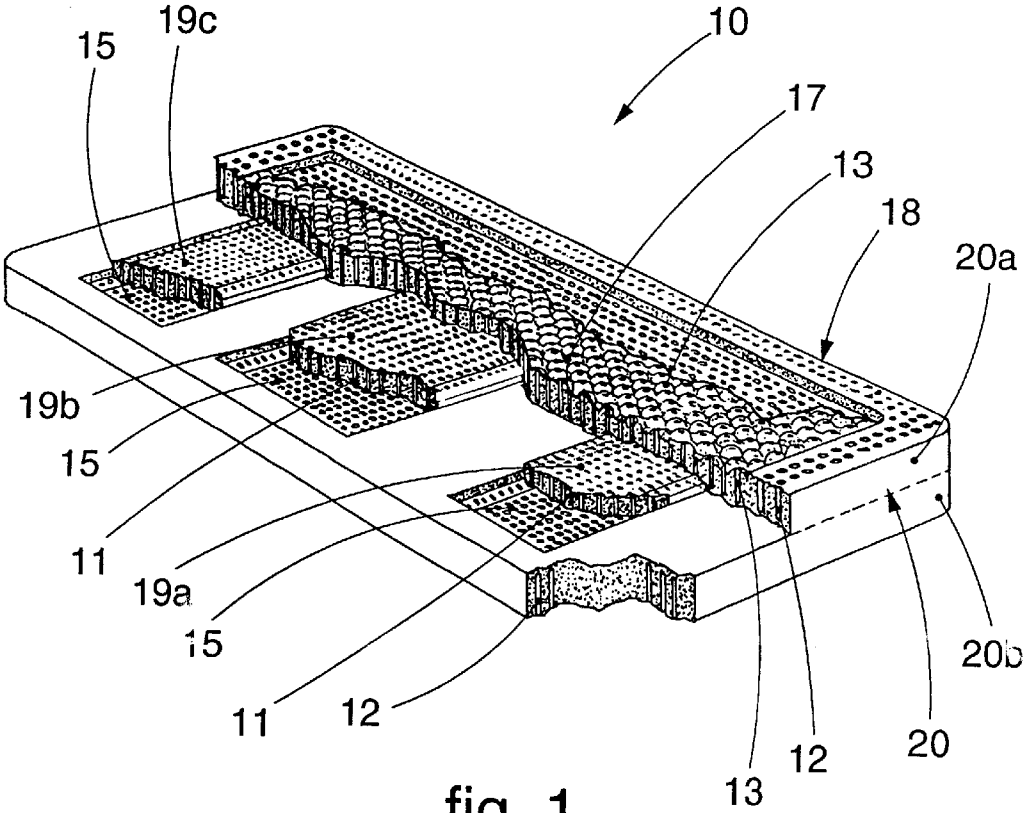

A mattress 10 according to the present invention is shown in the attached figures and consists, in this embodiment, of two parts or layers 20*a*, 20*b* of elastic material joined along main or wide surfaces thereof. In FIG. 1, the layers 20*a*, 20*b* are upper and lower layers, respectively, defining a body 20 of the mattress 10 with a generally parallelepiped shape. The upper and lower layers of the body 20 define the respective, counter-opposed lying surfaces or planes of the mattress 10. The upper and lower layers 20*a*, 20*b*, according to their structure and different composition, and/or according to the type of covering used, may define respectively the summer side and the winter side of the mattress 10. Preferably, the elastic material comprises latex or other suitable rubber material.

According to a variant, which is not shown here, there are three or more parts which are joined together and made solid so as to form the mattress 10. The body 20 is then appropriately covered by a covering which is not shown here.

According to the present invention, the mattress 10 has a peripheral frame 18 with second ventilation holes 12 and three reinforcing and stiffening bands 19, respectively 19*a*, 19*b* and 19*c*, which extend between the two long sides of the peripheral frame 18. The second ventilation holes 12, in a first embodiment, may be dead holes (i.e., blind holes). In another embodiment, the second ventilation holes 12 are through holes extending along the entire thickness of the respective layer of elastic material.

The reinforcing and stiffening bands 19*a*, 19*b* and 19*c* are arranged inside housing hollows 15 formed inside the body 20 of the mattress 10 and include, in this embodiment, first ventilation holes 11 which are vertical and parallel to one another. The first ventilation holes 11, according to the different embodiments and variants, may be either dead holes (i.e., blind holes) or through holes.

The reinforcing and stiffening bands 19*a*, 19*b* and 19*c* are preferably positioned respectively in correspondence with the shoulders, the buttocks and the feet of the user, and serve to guarantee a sufficiently rigid lying position which will support the user's body without the risk of being deformed and therefore without causing the user's spine to bend.

According to another embodiment, the reinforcing and stiffening bands 19*a*, 19*b* and 19*c* have different densities, each selected according to the different load they have to bear.

According to the present invention, at least one of the lying planes of the mattress 10 is shaped with a plurality of semi-spherical-shaped elements 17 which have the function of exerting a massaging action on the body of the user as he/she moves in the bed. The massaging effect encourages the circulation of the blood and gives the user a pleasant sense of well-being. The semi-spherical-shaped elements 17 are arranged side by side and may be of a substantially uniform density over the whole plane of the mattress 10 defined by the peripheral frame 18.

Figure 2:
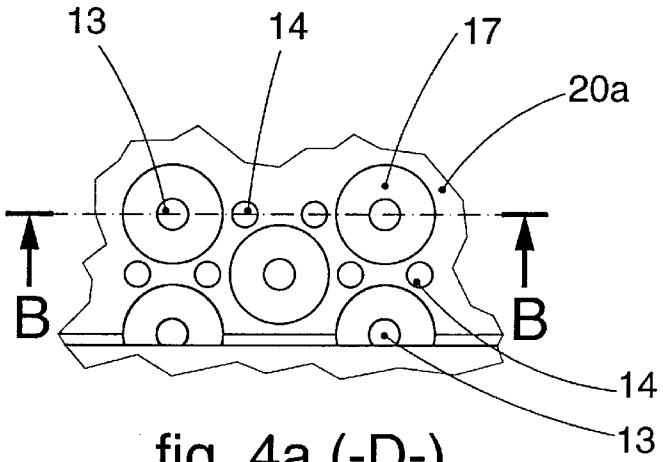
FIG. 2 shows a plane view of a variant of the mattress of FIG. 1.
Figure 2:
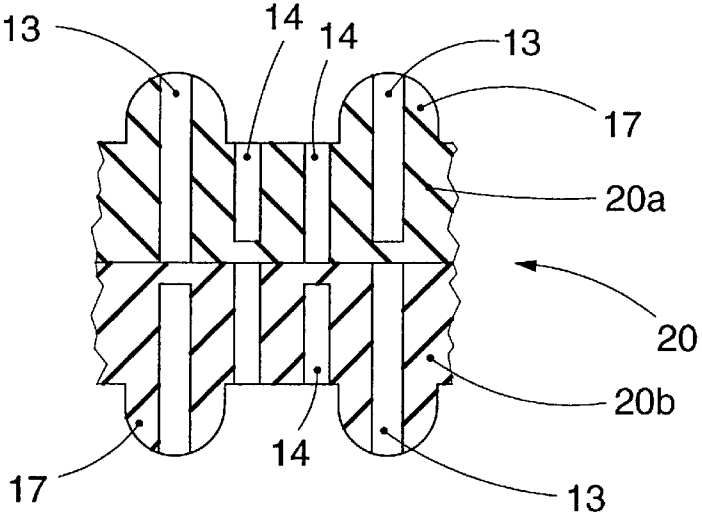
Figure 2:
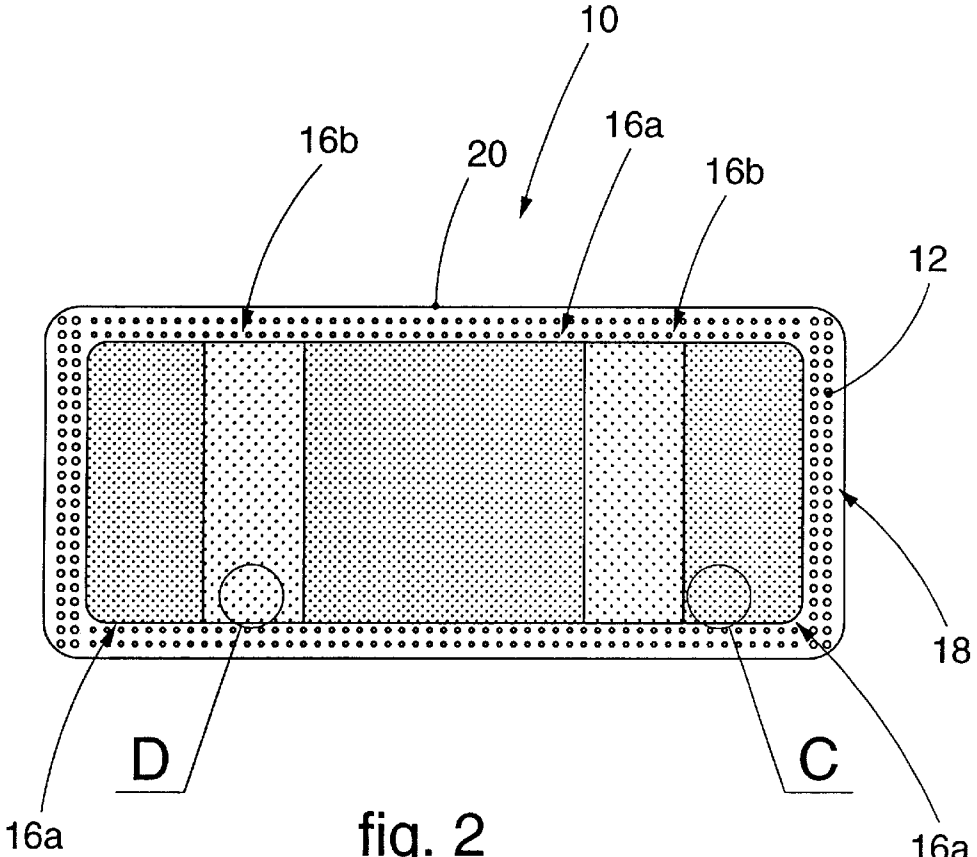

According to the embodiment of FIG. 2, the semispherical-shaped elements 17 have different densities according to their position with respect to the body of the user. In this embodiment, there are five transverse areas where the semispherical-shaped elements 17 have an alternate density. These are two transverse areas 16*b* with a lower density in correspondence with the user's shoulders and legs, and three transverse areas 16*a* with a greater density in correspondence with the other parts of the body. The semi-spherical-shaped elements 17 in the transverse areas 16*a* have a greater diameter (FIG. 4*a*) while the semi-spherical-shaped elements 17 in the transverse areas 16*b* have a lesser diameter.

According to the present invention, each of the semispherical-shaped elements 17 is provided with an axial ventilation hole 13. The axial ventilation hole 13 define third ventilation holes disposed on the lying plane of the mattress 10. In a first embodiment, as shown in FIG. 3*b*, at least some of the third ventilation holes 13 are through holes extending along the whole height of the mattress 10. According to a variant, as shown in FIGS. 3*a*–3*b*, at least some of the third ventilation holes 13 are dead holes. The third ventilation holes 13 act as elements through which the air can pass during movement of the user in bed, and thus allow the user's skin to breathe.

As shown in FIGS. 3*a*–3*b* and 4*a*–4*b*, ventilation holes 14 defining fourth ventilation holes are disposed between adjacent semi-spherical-shaped elements 17 in a position below the lying plane of the mattress 10. The fourth ventilation holes 14 also may be dead holes or through holes extending along the entire height of the mattress 10.

According to the present invention, the diameter and/or depth of each of the third ventilation holes 13 and/or each of the fourth ventilation holes 14 may be varied in accordance with the different positions along the length of the mattress 10 and the different densities and/or dimensions selected for the semispherical-shaped elements 17.

By the foregoing construction of the anatomical mattress according to the present invention, the following advantages are obtained:

(a) The anatomical mattress has an ergonomical design which is able to support the user by conforming to his/her physical characteristics, thereby ensuring a comfortable lying position and support by eliminating the presence of any areas of deformation or bending.

(b) The elements with the semi-spherical head, which define at least one of the lying surfaces of the anatomical mattress, become in contact with parts of the user's body and exert a massaging action to the user when the user moves. This massaging action has a beneficial effect on the blood circulation of the user and gives the user a pleasant feeling of well-being.

(c) The first, second, third and fourth holes have an advantageous ventilating function by allowing the passage of air, thereby assisting in the intake and outlet of air to permit the user's skin to breathe. This is particularly beneficial when the anatomical mattress is used in the summer months or in particularly hot and humid environments.

I claim:

1. An anatomical mattress comprising: at least two layers of elastic material each having a main surface, the two layers being joined along the main surfaces thereof to define a generally parallelepiped-shaped body, the body having a peripheral frame and two generally flat opposite surfaces, at least a portion of one of the opposite surfaces of the body having a plurality of semi-spherical-shaped elements extending outwardly therefrom and defining a lying plane of the mattress; and at least two transverse reinforcing and stiffening bands disposed in the body, one of the transverse reinforcing and stiffening bands being disposed substantially in correspondence with the shoulders of a user and the other transverse reinforcing and stiffening band being disposed substantially in correspondence with the feet of the user.

2. An anatomical mattress according to claim 1; further comprising a third transverse reinforcing and stiffening band disposed substantially in correspondence with the user's buttocks.

3. An anatomical mattress according to claim 2; wherein the transverse reinforcing and stiffening bands have first ventilation holes disposed generally at a right angle to the lying plane of the mattress.

4. An anatomical mattress according to claim 3; wherein the first ventilation holes comprise blind holes.

5. An anatomical mattress according to claim 3; wherein the first ventilation holes comprise through holes extending along the entire thickness of the transverse reinforcing and stiffening bands.

6. An anatomical mattress according to claim 1; wherein the semi-spherical-shaped elements have ventilation holes disposed generally perpendicular to the lying plane.

7. An anatomical mattress according to claim 6; wherein the ventilation holes comprise blind holes.

8. An anatomical mattress according to claim 6; wherein the ventilation holes comprise through holes extending along the entire height of the mattress (10).

9. An anatomical mattress according to claim 1; further comprising a plurality of ventilation holes disposed between adjacent semi-spherical-shaped elements and extending perpendicular to the lying plane.

10. An anatomical mattress according to claim 9; wherein the ventilation holes comprise blind holes.

11. An anatomical mattress according to claim 9; wherein the ventilation holes comprise through holes extending along the entire height of the mattress.

12. An anatomical mattress according to claim 1; wherein the peripheral frame does not have the semi-spherical-shaped elements.

13. An anatomical mattress according to claim 1; wherein the peripheral frame has ventilation holes disposed generally at a right angle to the lying plane of the mattress.

14. An anatomical mattress according to claim 13; wherein the ventilation holes comprise blind holes.

15. An anatomical mattress according to claim 13; wherein the ventilation holes comprise through holes extending along the entire height of the mattress.

16. An anatomical mattress according to claim 1; wherein transverse areas of the body are provided with the semi-spherical-shaped elements having varying sizes and/or densities.

17. An anatomical mattress according to claim 16; wherein the ventilation holes have diameters which vary according to the size and/or density of the semi-spherical-shaped elements.

18. An anatomical mattress according to claim 1; wherein both opposite surfaces of the body have the semi-spherical-shaped elements.

19. An anatomical mattress according to claim 18; further comprising a cover disposed on each of the opposite surfaces of the body; and wherein the characteristics of the opposite surfaces of the body and the cover are differentiated so as to define, respectively, a summer side and a winter side of the mattress.

20. An anatomical mattress according to claim 1; wherein the elastic material comprises rubber.

21. An anatomical mattress according to claim 1; wherein the elastic material comprises latex.

22. An anatomical mattress comprising: at least two layers each having a main surface, the two layers being connected along the main surfaces thereof to define a generally parallelepiped-shaped body, the body having a peripheral frame and two opposite surfaces, at least a portion of one of the opposite surfaces having a plurality of generally semi-spherical-shaped elements defining a lying plane of the mattress; at least three transverse reinforcing and stiffening bands disposed in the body, a first one of the transverse reinforcing and stiffening bands being disposed substantially in correspondence with the shoulders of a user when the user lies on the mattress, a second one of the transverse reinforcing and stiffening bands being disposed substantially in correspondence with the buttocks of the user, and a third one of the transverse reinforcing and stiffening bands being disposed substantially in correspondence with the feet of the user; and a plurality of ventilation holes disposed in the semi-spherical-shaped elements, in the peripheral frame, and in the first, second and third transverse reinforcing and stiffening bands, the ventilation holes extending generally perpendicular to the lying plane of the mattress.

23. An anatomical mattress according to claim 22; wherein each of the two layers of the body is made of an elastic material.

24. An anatomical mattress according to claim 23; wherein the elastic material comprises rubber.

25. An anatomical mattress according to claim 23; wherein the elastic material comprises latex.

26. An anatomical mattress according to claim 23; wherein the opposite surfaces of the body are generally flat.

27. An anatomical mattress comprising: at least two layers of elastic material each having a main surface, the two layers of elastic material being connected along the main surfaces thereof to define a body having a peripheral frame and first and second opposite surfaces, at least a portion of the first surface of the body having a plurality of semispherical-shaped elements extending outwardly therefrom to define a first lying plane of the mattress; and a plurality of reinforcing members disposed in the body along the first lying plane of the mattress at positions corresponding generally to the shoulder, buttocks and feet of a user when the user lies on the mattress.

28. An anatomical mattress according to claim 27; further comprising a plurality of ventilation holes each disposed in one of the semi-spherical-shaped elements.

29. An anatomical mattress according to claim 28; wherein the ventilation holes comprise through holes.

30. An anatomical mattress according to claim 28; wherein the ventilation holes comprise blind holes.

31. An anatomical mattress according to claim 28; further comprising a plurality of ventilation holes disposed between adjacent semi-spherical-shaped elements.

32. An anatomical mattress according to claim 27; further comprising a plurality of ventilation holes disposed in the semi-spherical-shaped elements, the peripheral frame and the reinforcing members.

33. An anatomical mattress according to claim 32; wherein the ventilation holes comprise through holes.

34. An anatomical mattress according to claim 32; wherein the ventilation holes comprise blind holes.

35. An anatomical mattress according to claim 27; further comprising a plurality of semi-spherical-shaped elements extending outwardly from at least a portion of the second surface of the body to define a second lying plane of the mattress.

36. An anatomical mattress according to claim 27; wherein the semi-spherical-shaped elements extend outwardly from different portions of the first surface of the body; and wherein the semi-spherical-shaped elements at each of the different portions of the first surface of the body have sizes and/or densities different from those disposed at the other different portions of the first surface of the body.

* * * * *